US011022108B2

(12) United States Patent
Weil et al.

(10) Patent No.: US 11,022,108 B2
(45) Date of Patent: Jun. 1, 2021

(54) ROTOR DEVICE FOR PERISTALTIC PUMP

(71) Applicant: Merck Patent GmbH, Darmstadt (DE)

(72) Inventors: Raoul Weil, Dorlisheim (FR); Emmanuelle Simon, Schnersheim (FR); Christophe Di-Palo, Gertwiller (FR); Vincent Schaal, Geispolsheim (FR)

(73) Assignee: Merck Patent GmbH, Darmstadt (DE)

( * ) Notice: Subject to any disclaimer, the term of this patent is extended or adjusted under 35 U.S.C. 154(b) by 10 days.

(21) Appl. No.: 15/328,696

(22) PCT Filed: Jun. 25, 2015

(86) PCT No.: PCT/EP2015/001280
§ 371 (c)(1),
(2) Date: Jan. 24, 2017

(87) PCT Pub. No.: WO2016/012072
PCT Pub. Date: Jan. 28, 2016

(65) Prior Publication Data

US 2017/0211567 A1 Jul. 27, 2017

(30) Foreign Application Priority Data

Jul. 24, 2014 (EP) ..... 14290217

(51) Int. Cl.
*F04B 43/12* (2006.01)
*F04B 49/02* (2006.01)
(Continued)

(52) U.S. Cl.
CPC ..... *F04B 43/1253* (2013.01); *F04B 43/0081* (2013.01); *F04B 43/09* (2013.01); *F04B 49/02* (2013.01); *F04B 51/00* (2013.01)

(58) Field of Classification Search
CPC .... F04B 43/1253; F04B 43/084; F04B 43/09; F04B 43/12; F04B 43/1276; F04B 45/06;
(Continued)

(56) References Cited

U.S. PATENT DOCUMENTS 4,231,707 A 11/1980 Tokorozawa et al.
4,473,173 A 9/1984 Degroff et al.
(Continued)

FOREIGN PATENT DOCUMENTS

CN 101978166 A 2/2011
CN 102345588 A 2/2012
(Continued)

OTHER PUBLICATIONS

Office Action dated May 3, 2018 in the corresponding Chinese 2015-0040444.0 Examination Procedure (pp. 1-10).
(Continued)

*Primary Examiner* — Alexander B Comley
(74) *Attorney, Agent, or Firm* — Millen, White, Zelano & Branigan, PC; Ryan Pool

(57) ABSTRACT

A rotor device for a peristaltic pump containing a housing, a supporting shaft extending in an axial direction and being mounted in the housing, a rotor which contains a rotor-body mounted on the supporting shaft and extending in a radial direction from the supporting shaft and a plurality of rollers, mounted on the radially outer portion of the rotor-body and a driving device connected to the supporting shaft for driving the rotor, in which the peristaltic pump further contains a number of roller-markers corresponding to the number of rollers, in which the roller-markers indicate a dead zone, the roller-markers are provided directly or indirectly on the supporting shaft.

5 Claims, 3 Drawing Sheets

(51) Int. Cl.
*F04B 43/09* (2006.01)
*F04B 43/00* (2006.01)
*F04B 51/00* (2006.01)

(58) Field of Classification Search
CPC ..... F04B 45/065; F04B 45/08; F04B 51/00; F04B 2201/1208; F04B 43/0081; F04B 49/02
USPC ..... 417/44.1, 476–477.2; 604/67
See application file for complete search history.

(56) References Cited

U.S. PATENT DOCUMENTS

| | | | | |
|---|---|---|---|---|
| 5,003,239 | A * | 3/1991 | Matthews | F04B 43/09 318/565 |
| 5,279,556 | A * | 1/1994 | Goi | G01D 5/36 604/67 |
| 8,939,740 | B2 | 1/2015 | Norman et al. | |
| 2005/0180856 | A1 | 8/2005 | Bach | |
| 2009/0214365 | A1* | 8/2009 | Norman | A61M 5/14232 417/474 |
| 2013/0030345 | A1* | 1/2013 | Gronau | A61M 1/16 604/6.01 |
| 2013/0189120 | A1 | 7/2013 | Nelson | |
| 2014/0044566 | A1 | 2/2014 | Miyazaki | |
| 2015/0125316 | A1 | 5/2015 | Katase | |
| 2015/0139836 | A1 | 5/2015 | Norman | |

FOREIGN PATENT DOCUMENTS

| | | | |
|---|---|---|---|
| CN | 102536757 | A | 7/2012 |
| EP | 1612423 | A1 | 1/2006 |
| JP | 54-102603 | A | 8/1979 |
| JP | 2013-256955 | A | 12/2013 |
| WO | 2009/105436 | A1 | 8/2009 |

OTHER PUBLICATIONS

International Search Report dated Sep. 30, 2015, issued in corresponding PCT/EP2015/001280, 3 pages.
Notification of reasons for refusal dispatched May 20, 2019 in corresponding JP appln. 2017-503817 (p. 1).

* cited by examiner

ROTOR DEVICE FOR PERISTALTIC PUMP

FIELD OF INVENTION

The present invention relates to an improved rotor device for a peristaltic pump and more particularly to a peristaltic pump comprising such a rotor device and to a method of using a peristaltic pump.

PRIOR ART

A peristaltic pump as used in the medical field is a pump whose rotor is provided with rollers that progressively compress the cross-section of an elastic hose to move a liquid within the hose. This kind of pump is therefore used to circulate a fluid inside a hose by operating the pump-rotor only on the hose without coming into contact with the liquid. A peristaltic pump is therefore suitable for any application requiring the liquid to remain in a confined atmosphere, for example, to avoid contamination of the liquid when working in a sterile environment. Generally, a peristaltic pump is adapted to operate in an environment where the concept of sterility is highly important. The pump must therefore not only fulfill its function of conveying a fluid within the hose and preventing its contamination by the environment, but also avoid contamination of the environment by the pump itself.

Presently there are many different peristaltic pumps on the market to perform sterility tests of liquid samples. These peristaltic pumps are used over a wide range of flow rates. For instance, the user might want to fill a rack of small test tubes with a certain amount of liquid. Usually, the peristaltic pump should be able to convey amounts in ml e.g. 0.5 to 10 ml or more per test tube. The user then fills the container of a dispensing apparatus using a peristaltic pump with the amount of liquid for the rack of test tubes, and the peristaltic pump then pumps the specific volume of, for example, 2 ml in each test tube. When filling the test tubes is done, a flushing liquid is filled in the container and the hose is flushed with the flushing liquid by conveying the flushing liquid through the hose. For this, a different container suitable for receiving the flushing liquid is placed to the outlet of the dispensing apparatus. In this way, the dispensing apparatus is cleaned after use.

However, to fill the test tubes in the rack, the peristaltic pump must be able to convey very small amounts of liquids, e.g. as stated above down to 0.5 ml. These amounts are controlled by the peristaltic pump usually by specifying the speed of conveying the liquid and the time the peristaltic pump is operating. In this so called timer mode the accuracy of the delivered volume of liquid is affected by the non-transferred volume of the zone of the tube that is squeezed by the rolls, as can be seen in FIG. 1. This dead zone DZ is a zone in which no liquid can be transferred in the hose. To keep a good accuracy, it is necessary to monitor the position of the rolls of the rotor so that the dead zones DZ can be compensated in the conveyed and delivered volume of the liquid. Thus, it is very important that the dead zones DZ are correctly evaluated while the peristaltic pump is conveying the liquid through the tube.

Presently, the angular positions of the rolls are defined via the pulses coming out of the brushless motor driver. A sensor detects an initialization position that gives the 0° and then the dead zones related to the rolls are positioned according to this initial position. For this usually a graph or a look-up-table (LUT) with an encoder wheel is used. The encoder wheel has known equispaced sectors which are not linked directly to the position of the dead volume. Furthermore, speed adjustment (maximum velocity) coupled with the encoder wheel indicating the dead volume position where the speed must be increased can also be used. However, these methods can cause troubles because the output signal from the motor driver might not accurately determine the angular position of the rotor due to bad information from the electronic driver.

Such a method is, for example, used in U.S. Pat. No. 4,473,173 in which the known output curve of the peristaltic pump is divided into known segments and evaluated by the microprocessor input device. A segment of the output curve is utilized which positively displaces a known volume and is very repeatable.

US 2005/0180856 A disclose a stepper motor that can be mechanically coupled to a rotational position encoder so that a measure of the rotation position of the motor can be fed back to the processor. The processor can cause the stepper motor to interpolate between pulse positions of the encoder.

SUMMARY OF THE INVENTION

An object of the invention is to provide a peristaltic pump for a dispensing apparatus with an improved possibility of monitoring the dead zone influencing the output of the pump. This object is achieved by a rotor device for a peristaltic pump comprising a housing, a supporting shaft extending in an axial direction and mounted in the housing, a rotor comprising a rotor body mounted on the supporting shaft and extending in an radial direction from the supporting shaft and having a plurality of rollers mounted on the radially outer portion of the rotor, the rollers are preferably spaced equally in circumferential intervals, a driving device connected to the supporting shaft for driving the rotor, wherein the rotor device further comprises a number of roller-markers corresponding to the number of rollers directly or indirectly provided on the supporting shaft, wherein the roller-markers indicate a dead zone. The markers can easily be detected by a corresponding sensor. Thus, the position of the rotor is defined structurally directly or indirectly on the supporting shaft and no more errors due to bad information from the electronic driver can occur. Furthermore, it is easier to monitor the angular position of the rotor and the user gets a good repeatability of volume transfer for small volumes, i.e. small timer inputs. Finally, the markers can be provided on any place along the supporting shaft or the rotor, which makes the provision of markers a very flexible in view of constructional conditions or necessities.

The rotor device can further comprise an initialization-marker to indicate an initial position of the rotor directly or indirectly provided on the supporting shaft. Basically, this initialization-marker can be one of the roller-markers, as long as the circumferential intervals of the rollers and of the corresponding markers are regular (equal intervals) and both the roller and the roller-markers are on corresponding positions in the circumferential position in view of the supporting shaft which supports both, the rotor and the roller-markers. However, the initialization-marker can also be a separate marker which allows easy definition of the same start position after initialization. As mentioned above, the roller-markers are preferably spaced in intervals corresponding to the intervals of the rollers, more preferably the rollers and the roller-markers have an identical position in circumferential direction in view of the supporting shaft. This further eases the evaluation since the exact position of every dead zone which corresponds to the roller position, can very accurately be defined.

The roller-markers and/or the initialization-marker can be provided on a control disc supported by the supporting shaft. The control disc is fixed to the supporting shaft so that no relative movement can occur between the shaft and the disc. Also the control disc is a very flexible element to reliably detect the markers and to co-operate with a respective sensor.

The roller-marker and/or the initialization marker are preferably formed as protrusions on the supporting shaft or on the control disc. Such protrusions are easy to detect by different sensors (optical, inductive sensor). In particular the protrusions can be formed on the outer circumference of the control disc. This allows a very small spaced arrangement of the rotor elements and the sensor in axial direction.

The sensor for detecting the markers does not have to be a part of the rotor, but it preferably is fixed to the housing of the rotor device to ensure accurate positioning of the sensor in view of the markers. The sensor can be a great variety of sensors, for example optical sensors which cannot only detect a protrusion, but also colored markers or phosphorescing material, but preferably the sensor is an inductive sensor that is very reliable in view of a structurally protruding marker.

The invention relates particularly to a peristaltic pump comprising a rotor device as mentioned above. The peristaltic pump further comprises a movable jaw disposed adjacent to the rotor, the movable jaw is movable between a conveying position in which the hose is fixed between the movable jaw and the rollers of the rotor and in which the liquid in the hose can be conveyed, and a loading position in which the movable jaw is spaced apart from the rollers of the rotor and the hose can be unloaded/taken out from the peristaltic pump or loaded into the peristaltic pump. The peristaltic pump further comprises a control device for controlling the functions of the peristaltic pump and the rotor and for monitoring the initial position and the rotation of the rotor with regard to the initial position. Such a peristaltic pump can comprise the sensor that detects the markers directly or indirectly connected to the supporting rod of the rotor device if the sensor is not comprised by the rotor device.

Another aspect of the invention is a method for transferring small or micro-volumes with a peristaltic pump, comprising the steps of inserting the hose, beginning to convey a liquid with the peristaltic pump, thereby detecting the markers on the control disc corresponding to the rollers and evaluating the conveyed liquid based on the detected markers. Preferably, before inserting the hose an initialization step comprising the detection of the marker for the initial position on the control disc is carried out.

DESCRIPTION OF THE PREFERRED EMBODIMENTS

In the following, the terms "axial", "radial" and "circumferential" are used. These are used in view of the element supporting shaft, i.e. actual depicts a direction along the supporting shaft, radial depicts a direction perpendicular to the axial direction of the supporting shaft and circumferential depicts a rotation direction of the supporting shaft (clockwise or counter-clockwise). Furthermore, if a reference number is used without letter, it is a reference to all reference signs with this number (for example the reference number 13 means both reference numbers 13*a* and 13*b*).

The invention relates to a rotor device 10 of a peristaltic pump. A peristaltic pump is shown in FIG. 6 and described for example in EP 1 612 423 A1 in greater detail.

Figure 1:
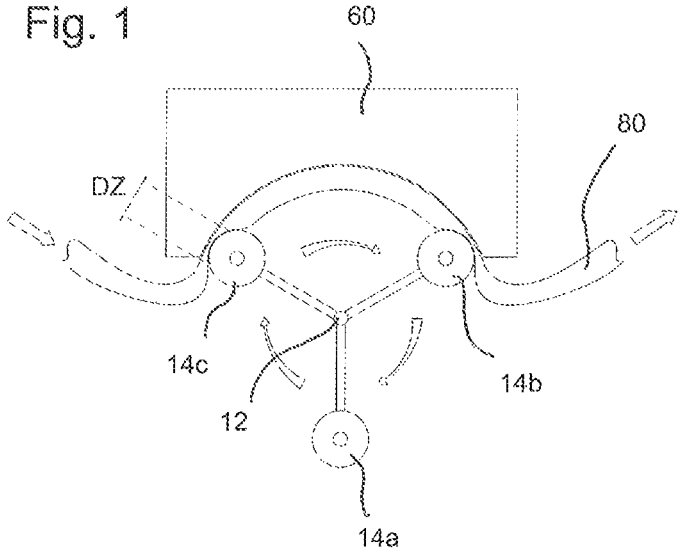
FIG. 1 shows a schematic view of a peristaltic pump in which the dead zone is high-lighted.

FIG. 1 shows a schematic picture of the rotor 10, the jaw 60 and the hose 80. Furthermore, the dead zone DZ is indicated which occurs when a roller presses the hose 80 against the jaw 60 while the rotor 12 is rotating. The dead zone DZ moves with the roller 14 along the jaw 60. In this way, the liquid in the tube is pressed forward and conveyed to the outlet of the hose 80. However, in the dead zone DZ no liquid can be conveyed.

Figure 2:
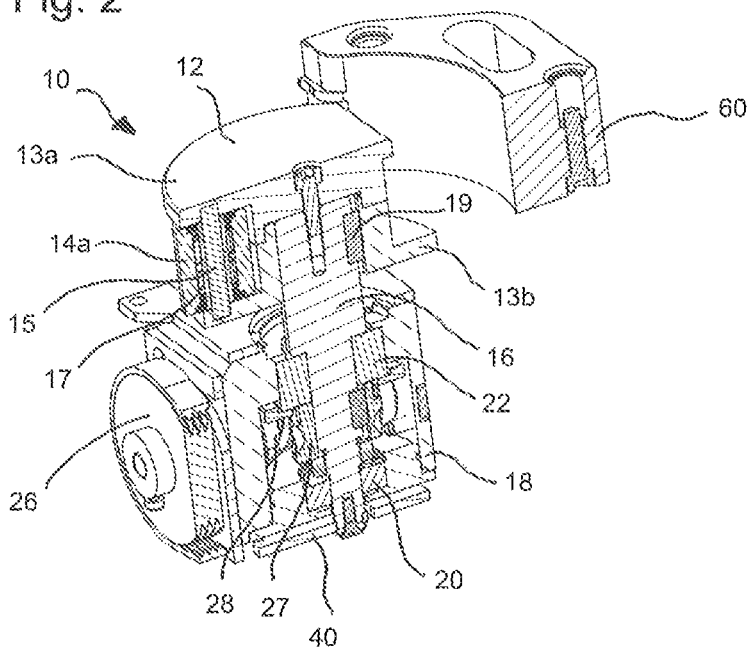
FIG. 2 shows a section of the rotor device of the peristaltic pump.

FIG. 2 shows a section of the rotor device 10 as used in a peristaltic pump 50. Also shown is the movable jaw 60, which is part of the peristaltic pump and which serves to clamp the hose 80 between the movable jaw 60 and the rollers 14.

The rotor device 10 comprises a supporting shaft 16 that extends in an axial direction. The supporting shaft 16 is supported or mounted in the housing 18 by the lower and upper bearings 20 and 22. On the upper end portion of the supporting shaft 18 is mounted a rotor 12 comprising a rotor body 13. One or more rollers 14 are mounted on the radially outer portion of the rotor 12. In the present embodiment, the rotor 12 comprises an upper and a lower rotor body 13*a*, 13*b* which mount a bearing rod 15 having a bearing 17 (for example, a needle bearing) on which the respective roller 14 is mounted and by which the roller 14 can rotate around the bearing rod 15.

Preferably, there are three or more rollers 14*a*, 14*b*, 14*c* disposed in a circumferential direction of the rotor 12. With three rollers it is possible to reduce the enclosing geometry of the movable jaw 60 to enable easy loading and unloading of a hose 80 in the peristaltic pump 50 (i.e. the moveable jaw does not have to enclose a major portion of the rotor). However, of course there can be also four, five or any other number of rollers as long as the circumferential geometry of the rotor 12 allows enough space for the rollers 14.

The rotor 12 is in the present embodiment connected to the supporting shaft 16 via a feather key 19 and a screw 24 which is screwed into the center of the upper surface of the rotor and into the upper ending of the supporting shaft 16. The feather key 19 serves to relatively fix the rotor 12 with the supporting shaft 16 in a circumferential direction so as to securely transmit the rotation of the supporting shaft to the rotor 12.

The supporting shaft 16 is driven by a driving device, which is in the present case a pulley 26 connected to a worm gear 28 which drives a corresponding pinion 27 fixed to the supporting shaft 16. The pulley 26 is connected to an electric motor 30 (see FIG. 3) via a belt. However, it is also possible that the pulley 26 is replaced by a toothed gear and is directly connected to the electric motor via another toothed gear(s). Furthermore, it is theoretically also possible that the electric motor is incorporated into the housing 18 of the rotor device 10 and directly drives the supporting shaft 16.

The shaft 16 can directly or indirectly comprise markers which indicate a position of a roller, i.e. the markers can be formed directly on the supporting shaft 16, but can also be formed on a further element like a control disc as described later in this application. Generally, the markers 41, 42 can be optical markers, like a certain color, a phosphorescing agent or also metal stripes. These markers 41 can be detected by different sensors 35 like optical sensors or by an inductive sensor. The roller-markers 41 are preferably arranged in the same angular position as the rollers are in the rotor. More particularly, the roller-markers 41 should indicate the exact position of each rotor, i.e. the roller-markers 41 are spaced directly or indirectly on the supporting-shaft 16 in a way so that the position of a roller-marker 41 also indicates where the roller 14 of the rotor is. In other words, the relative position of the roller 14 in view of the supporting shaft 16 is the same position as the corresponding marker 41 has.

In the preferred embodiment, a control disc 40 is provided at the lower end of the supporting shaft 16. Here, the control disc 40 is placed on the opposite end of the supporting shaft 16 as the rotor 12, but it is possible to place such a control disc 40 on any place along the supporting shaft 16 as long as the constructional space allows it. This makes it possible to have a very flexible marker system, which can be placed anywhere on the supporting shaft 16 and can be adapted to different rotor device constructions.

The control disc can comprise also optical markers, but in a preferred embodiment the makers are formed as protrusions which are preferably provided on the outer circumference of the control disc 40. In the present case, since there are three rollers 14*a*, 14*b*, 14*c*, there are three protrusions 41*a*, 41*b* and 41*c*. These protrusions can be formed unique in width and/or length so that the sensor 35, for example an inductive sensor, can distinguish between the single markers/protrusions 41. Thus, the sensor cannot only detect that a roller 14 is in a certain position, bur also which exact roller 14 is in the position.

Furthermore, it is advantageously to also define an initial position of the rotor 12 by means of the control disc 40. Basically, any of the markers/protrusions can be used as a marker for an initial position, in particular if the different markers 41*b*, 41*a* and 41*c* are distinguishable as mentioned above. However, in view of the position of the rollers 14 it is possible that an additional marker is preferred as the initialization marker 42. This makes it possible that the rotor 12 can be initialized in a predetermined position which not necessarily has to coincide with one of the roller-markers 41. Another possibility is to place the sensor 35 in a predetermined position, so that if any roller-marker 41 or a certain roller-marker 41 is detected, the rotor 12 is in the initial position. Of course, for this purpose also a second sensor could be provided.

Figure 3:
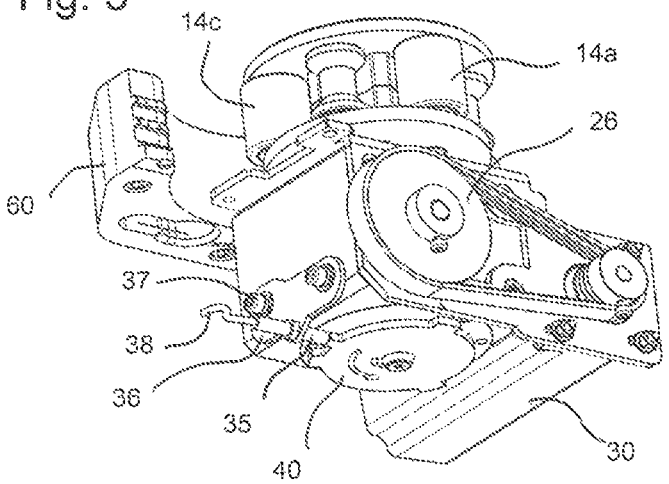
FIG. 3 shows an isometric bottom view on the rotor device for the peristaltic pump.
Figure 4:
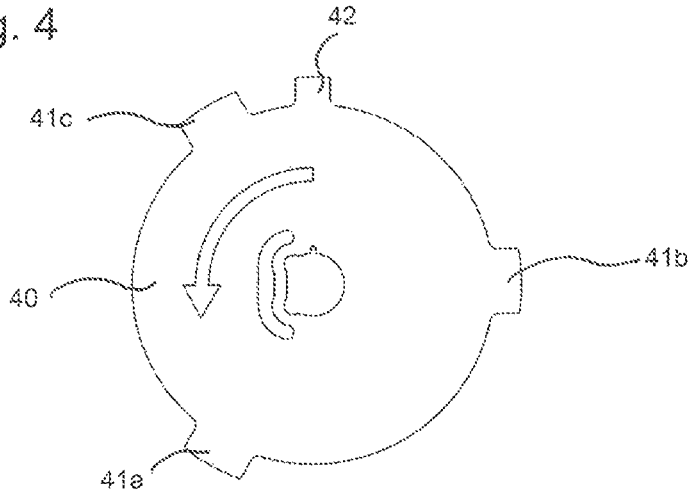
FIG. 4 shows a control disc used by the rotor device and having protrusions as markers.

The sensor 35 can be seen in FIG. 3. Here, the sensor is fixed to the housing 18 of the rotor via a fixing plate 36 and screws 37. The sensor 35 can be wireless, but in the present case there is a wire 38 that connects the sensor 35 to a control device (not shown) provided in the peristaltic pump.

Figure 5:
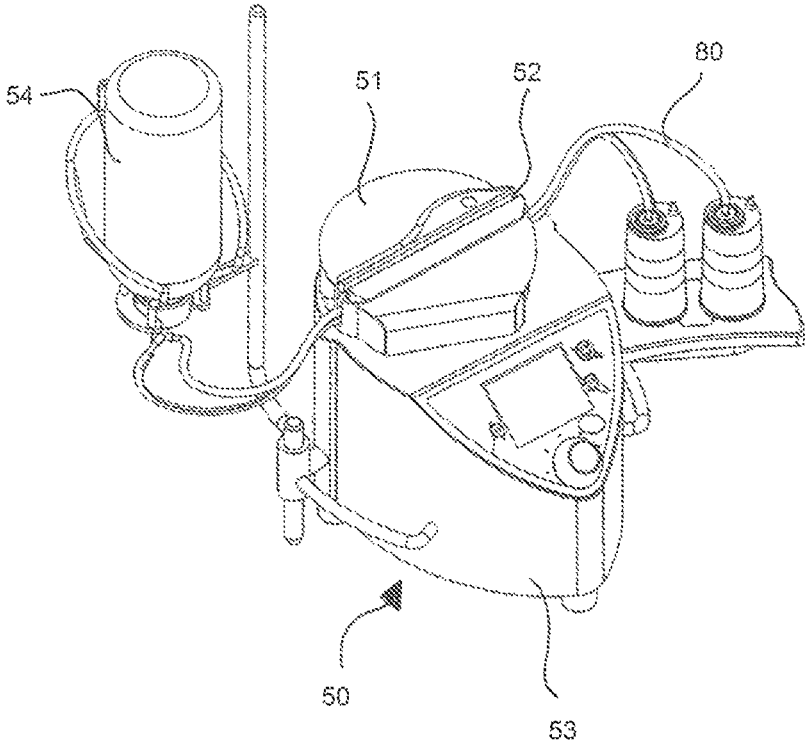
FIG. 5 shows a dispensing apparatus comprising a peristaltic pump.

In FIG. 5 is shown such a peristaltic pump 50. The peristaltic pump has a housing 53, which comprises the rotor device 10, and serves as a stator for the rotor. On the upper surface is provided the movable jaw 60, which is covered by the cover 51 as can be seen in FIG. 5. The cover has a slit 52, through which the hose or the hoses 80 can be guided.

Furthermore, the peristaltic pump 50 comprises a control device for controlling all functions of the peristaltic pump 50 and the rotor device 10. Furthermore, the control device also monitors the initial position and the rotation of the rotor with regard to the initial position. The user determines a speed and a time of the rotor rotation to have the required volume to be conveyed.

In case the rotor does not comprise a sensor 35 which is fixed on the rotor housing, the peristaltic pump 50 may comprise the sensor 35 for detecting the markers 41.

To use the peristaltic pump 50, the container 54 is filled with a liquid, the rotor is brought into the initial position and the movable jaw is moved into the loading position. Then, the hoses are loaded into the peristaltic pump, in particular into the slit 52 and the movable jaw is moved into the conveying position close to the rotor 12. After that, the rotor begins to rotate and the liquid is conveyed within the hose 80. During conveying the liquid, the markers are detected by the corresponding sensor and the dead zones DZ of the rollers can accurately be evaluated. Thus, the conveyed liquid can also be very accurately determined based on the detected markers and the time and speed of the rotor rotation.

The invention furthermore relates to a method for transferring small/micro-volumes with a peristaltic pump as described above, comprising the steps of moving the moveable jaw (60) in the loading position, inserting the hose (80), moving the moveable jaw (60) in the conveying position, beginning to convey a liquid with the peristaltic pump (50), thereby detecting the markers (41) corresponding to the rollers (14) and evaluating the conveyed liquid based on the detected markers (41). In a preferred embodiment said method is further comprising the step of moving the rotor (12) in an initial position by detecting the marker (42) for the initial position.

The invention claimed is:

1. A rotor device (10) for a peristaltic pump (50) comprising: a housing (18); a supporting shaft (16) extending in an axial direction and supported in the housing (18); a rotor (12) comprising a rotor-body (13) mounted on the supporting shaft (16) and extending in a radial direction from the supporting shaft (16) and a plurality of rollers (14), mounted on a radially outer portion of the rotor-body (13); a driver (26, 27, 28) connected to the supporting shaft (16) for driving the rotor (12); a number of roller-markers (41) corresponding to the number of rollers (14), wherein the roller-markers (41) indicate a dead zone (DZ) of a hose; and an initialization-marker (42) to indicate a predetermined initial position of the rotor (12) before insertion of the hose; wherein the initialization marker (42) is a separate marker from any of the roller-markers (41) and is not defined by any of said roller-markers (41); wherein both the roller-markers (41) and the initialization marker (42) are formed on a control disc (40); wherein the initialization marker (42) defines the predetermined initial position of the rotor each time initialization occurs; wherein the roller-markers (41) and the initialization marker (42) are formed as protrusions on the control disc (40); and wherein the protrusions (41, 42) are formed on an outer circumference of the control disc (40).

2. The rotor device (10) according to claim 1, wherein the roller-markers (41) are spaced in intervals corresponding to intervals of the rollers (14).

3. The rotor device (10) according to claim 1, further comprising a sensor (35) for detecting the markers (41, 42) on the control disc (40).

4. A peristaltic pump (50) comprising a rotor device (10) according to claim 1, a moveable jaw (60) disposed adjacent to the rotor (12), the moveable jaw (60) is moveable between a conveying position and a loading position;

a control device for controlling the peristaltic pump (50) and for monitoring the predetermined initial position and the rotation of the rotor (12) with regard to the predetermined initial position.

5. A method for transferring small/micro-volumes with the peristaltic pump according to claim 4, comprising: moving the moveable jaw (60) into the loading position; moving the rotor (12) to the predetermined initial position before insertion of the hose by detecting the initialization marker (42); inserting a hose (80); moving the moveable jaw (60) into the conveying position; beginning to convey a liquid with the peristaltic pump (50), and detecting the roller-markers (41) corresponding to the rollers (14); evaluating the conveyed liquid based on the detected roller-markers (41).

* * * * *